US008433222B2

(12) United States Patent
Klenkler et al.

(10) Patent No.: US 8,433,222 B2
(45) Date of Patent: Apr. 30, 2013

(54) SINGLE LAYER PHOTORECEPTOR AND METHODS OF USING THE SAME

(75) Inventors: Richard A. Klenkler, Oakville (CA); Gregory McGuire, Oakville (CA); Matthew A. Heuft, Oakville (CA)

(73) Assignee: Xerox Corporation, Norwalk, CT (US)

( * ) Notice: Subject to any disclaimer, the term of this patent is extended or adjusted under 35 U.S.C. 154(b) by 254 days.

(21) Appl. No.: 12/828,177

(22) Filed: Jun. 30, 2010

(65) Prior Publication Data

US 2012/0003578 A1 Jan. 5, 2012

(51) Int. Cl.
*G03G 15/06* (2006.01)
*G03G 15/02* (2006.01)

(52) U.S. Cl.
USPC ..... 399/222; 399/159; 430/56; 430/58.75

(58) Field of Classification Search ..... 430/56, 430/58.05, 58.75, 96; 399/159, 222
See application file for complete search history.

(56) References Cited

U.S. PATENT DOCUMENTS 3,121,006 A 2/1964 Middleton et al.
7,070,892 B2 7/2006 Bender et al.
7,223,507 B2 5/2007 Ioannidis et al.
2004/0197685 A1 10/2004 Ioannidis et al.
2005/0164106 A1 7/2005 Bender et al.
2009/0087142 A1* 4/2009 Shibayama ..... 385/33
2010/0279217 A1* 11/2010 Yu et al. ..... 430/58.8
2011/0195353 A1* 8/2011 Belknap et al. ..... 430/56

OTHER PUBLICATIONS

Applied Physics Letters, Electron Transport in Naphthylamine-Based Organic Compounds, S. C. Tse, et al., 89, 262102 (2006), 3 pages.
Synthetic Metals, Stability of N-Type Doped Conducting Polymers and Consequences for Polymeric Microelectronic Devices, D. M. de Leeuw, et al., 87 (1997), pp. 53-59.

* cited by examiner

*Primary Examiner* — Stewart Fraser
(74) *Attorney, Agent, or Firm* — Pillsbury Winthrop Shaw Pittman LLP

(57) ABSTRACT

The presently disclosed embodiments relate generally to layers that are useful in imaging apparatus members and components, for use in electrophotographic, including digital, apparatuses. In particular, the present embodiments pertain to an improved imaging member comprising a single layer in which the single layer further comprises a photoactive material in a polymeric binder. The embodiments are free of photosensitive pigments and traditional electron transporting small molecules.

13 Claims, 5 Drawing Sheets

SINGLE LAYER PHOTORECEPTOR AND METHODS OF USING THE SAME

BACKGROUND

The presently disclosed embodiments relate generally to layers that are useful in imaging apparatus members and components, for use in electrophotographic, including digital, apparatuses. More particularly, the present embodiments pertain to an improved imaging member comprising a single layer in which the single layer further comprises photoactive materials as a hole transport molecule in a polymeric binder. Unlike conventional single-layer photoreceptors, the embodiments are free of photosensitive pigments and traditional electron transporting small molecules. In addition, the imaging member relies on ultra violet (UV) photogeneration of electron hole pairs in the hole transport molecule itself to discharge the surface potential of the imaging member and create a latent image.

In electrophotography, also known as xerography or electrophotographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment moves under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Typical multi-layered photoreceptors or imaging members have at least two layers, and may include a substrate, a conductive layer, an optional undercoat layer (sometimes referred to as a "charge blocking layer" or "hole blocking layer"), an optional adhesive layer, a photogenerating layer (sometimes referred to as a "charge generation layer," "charge generating layer," or "charge generator layer"), a charge transport layer, and an optional overcoating layer in either a flexible belt form or a rigid drum configuration. In the multi-layer configuration, the active layers of the photoreceptor are the charge generation layer (CGL) and the charge transport layer (CTL). Enhancement of charge transport across these layers provides better photoreceptor performance. Multi-layered flexible photoreceptor members may include an anti-curl layer on the backside of the substrate, opposite to the side of the electrically active layers, to render the desired photoreceptor flatness.

A drawback to the multi-layered photoreceptors is that such photoreceptors are costly and complicated to manufacture and maintain. Ideally, single layer photoreceptors would be used due to their simple design and cost efficiency. Such photoreceptors are disclosed in U.S. Pat. Nos. 7,070,892 and 7,223,507, and U.S. Publication Nos. 20040197685 and 20050164106, which are hereby incorporated by reference in their entireties. Single layer organic photoreceptors represent the most efficient photoreceptor structure for resolution, cost of manufacture and maintenance and manufacturing simplicity. The main advantages over multi-layer photoreceptors stem from the generating property of the top-surface of the single layer design. Photogeneration at the top surface eliminates the need for anti-plywood treatment of the substrate and also eliminates charge spreading, thus facilitating higher resolution imaging. In addition, single layer photoreceptors allow for greater layer thickness to be used for the single layer and provides for more wear resistance and thus longer photoreceptor life.

However, there are obstacles to obtaining a single layer photoreceptor that operates as desired. The difficulty in designing a usable single layer photoreceptor lies in the selection of compatible hole and electron transport materials, which must also be compatible with the selected charge generating material, typically a pigment, and the binder, and have resulted in failure due to poor discharge performance. Many problems need to be overcome including charge acceptance for hole and/or electron transporting materials from photoelectroactive charge generating material. In addition to electrical compatibility and performance, a material mix for forming a single layer photoreceptor should possess the proper rheology and resistance to agglomeration to enable acceptable coatings. Because it is very difficult to find a combination that meets all of the above requirements, multi-layered devices have generally been used.

Thus, there is a need for an improved photoreceptor design, such as a single layer device, that avoids the problems such as that described above.

The term "photoreceptor" or "photoconductor" is generally used interchangeably with the terms "imaging member." The term "electrophotographic" is generally interchangeable with "xerographic." The terms "charge transport molecule" are generally used interchangeably with the terms "hole transport molecule."

SUMMARY

According to aspects illustrated herein, there is provided a single layer imaging member comprising: a metalized substrate, and a single layer disposed over the metalized substrate, the single layer further comprising a photoactive material in a polymeric binder. In embodiments, the photoactive material is included to act as a hole transport molecule, an electron transport molecule and a charge generating material.

In other embodiments, there is a method for forming images, comprising applying a source of ultra violet light on a surface of the imaging member described above to create an electrostatic latent image. The light source may be selected from the group consisting of a laser and light-emitting diodes.

Another embodiment, there is a method for forming images, comprising: creating an electrostatic latent image on a charge retentive-surface for receiving the electrostatic latent image thereon, further comprising: positively or negatively electrostatically charging a single layer imaging member which comprises a metalized substrate, and a single layer disposed over the metalized substrate, the single layer further comprising a photoactive material to act as hole transport molecule, an electron transport molecule and a charge generating material in a polymeric binder, applying an ultra violet light on a surface of the single layer imaging member to selectively discharge the surface, and allowing the ultra violet light to be absorbed by the tri-arylamine compound to generate electron hole pairs near the imaging member surface such that the electron hole pairs separate due to an electric field applied by static charge on the imaging member surface and charge is transported in accordance to the direction of the field to create the electrostatic latent image; developing the electrostatic latent image to form a developed image on the charge-retentive surface; transferring the developed image from the charge-retentive surface to a copy substrate; and fusing the developed image to the copy substrate.

Yet another embodiment provides an image forming apparatus for forming images on a recording medium comprising: a) a single layer imaging member having a charge retentive-surface for receiving an electrostatic latent image thereon, wherein the single layer imaging member comprises a metalized substrate, and a single layer disposed over the metalized substrate, the single layer further comprising a photoactive material to act as a hole transport molecule, an electron transport molecule and a charge generating material in a polymeric binder; b) a development component for applying a developer material to the charge-retentive surface to develop the electrostatic latent image to form a developed image on the charge-retentive surface; c) a transfer component for transferring the developed image from the charge-retentive surface to a copy substrate; and d) a fusing component for fusing the developed image to the copy substrate.

BRIEF DESCRIPTION OF THE DRAWINGS

For a better understanding, reference may be made to the accompanying figures.

DETAILED DESCRIPTION

Figure 1:
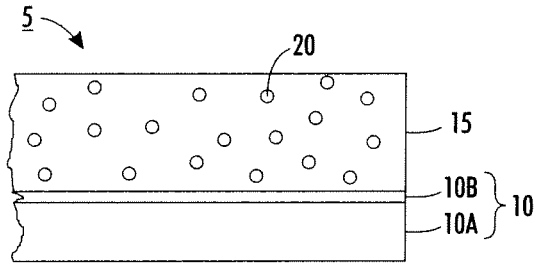
FIG. 1 is a cross-sectional view of an imaging member having a single layer configuration according to the present embodiments.

In the following description, reference is made to the accompanying drawing, which form a part hereof and which illustrate several embodiments. It is understood that other embodiments may be used and structural and operational changes may be made without departure from the scope of the present disclosure.

The presently disclosed embodiments are directed generally to an electrophotographic imaging member which comprises a single layer in which the single layer further comprises photoactive materials as a hole transport molecule in a polymeric binder. In one specific embodiment, the photoactive material may comprise certain tri-arylamines, such as N—N'-diphenyl-N,N'-bis(3-methylphenyl)-[1,1'-biphenyl]-4,4'-diamine (TPD), and the polymeric binder may be a polycarbonate binder. Unlike conventional single-layer photoreceptors, the embodiments are free of photosensitive pigments and traditional electron transporting small molecules. Although the discussion will address the use of tri-arylamines as the photoactive materials, the imaging members of the present disclosure may also use other photoactive materials as well. In addition, the imaging member relies on ultra violet (UV) photogeneration of electron hole pairs in the hole transport molecule itself to discharge the surface potential of the imaging member and create a latent image. The novel imaging member allows for high resolution top surface imaging with small pixels facilitated by the use of a UV light-emitting diode (LED) or laser illumination. Experimental results demonstrate that under suitable conditions the xerographic discharge rate characteristics of the present embodiments is no different than that of conventional dual-layer photoreceptors. Furthermore, the single layer imaging member provides a highly efficient structure for image resolution, manufacturing simplicity and imaging member longevity.

In a typical electrophotographic reproducing or digital printing apparatus using a photoreceptor, a light image is recorded in the form of an electrostatic latent image upon a photosensitive member and the latent image is subsequently rendered visible by the application of a developer mixture. The developer, having toner particles contained therein, is brought into contact with the electrostatic latent image to develop the image on an electrophotographic imaging member which has a charge-retentive surface. The developed toner image can then be transferred to a copy substrate, such as paper, that receives the image via a transfer member.

Typical photoreceptors or imaging members are based upon a multi-layered configuration. As discussed in the background section, however, multi-layered photoreceptors are costly and complicated to manufacture and maintain, and ideally, a single layer photoreceptor is more desirable for use due to their simple design and cost efficiency. As also discussed in the background section, it is difficult to obtain a single layer photoreceptor that operates as desired because such a configuration requires the selection of compatible hole and electron transport materials, which must also be compatible with the selected charge generating material, typically a pigment. Additionally, each of the selected materials must also be soluble in the same solvent/binder system and allow good capacitive charging while also providing good transport of photogenerated charge.

In the present embodiments, a single layer imaging member is achieved which avoids the above-described problems. The single layer comprises a photoactive material in a polymeric binder to facilitate the movement of both holes and electrons through the imaging member to provide discharge speed and physical robustness similar to that of current dual-layer designs while further providing lower manufacturing costs and superior latent image resolution not achievable by the dual-layer designs.

In embodiments, the photoactive material may be a tri-arylamine having the following formula:

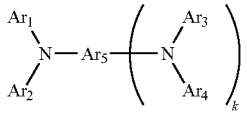

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1. $Ar^5$ may be further defined as, for example, a substituted phenyl ring, substituted/unsubstituted phenylene, substituted/unsubstituted monovalently linked aromatic rings such as biphenyl, terphenyl, and the like, or substituted/unsubstituted fused aromatic rings such as naphthyl, anthranyl, phenanthryl, and the like. In further embodiments, the tri-arylamine may be selected from any of the following group:

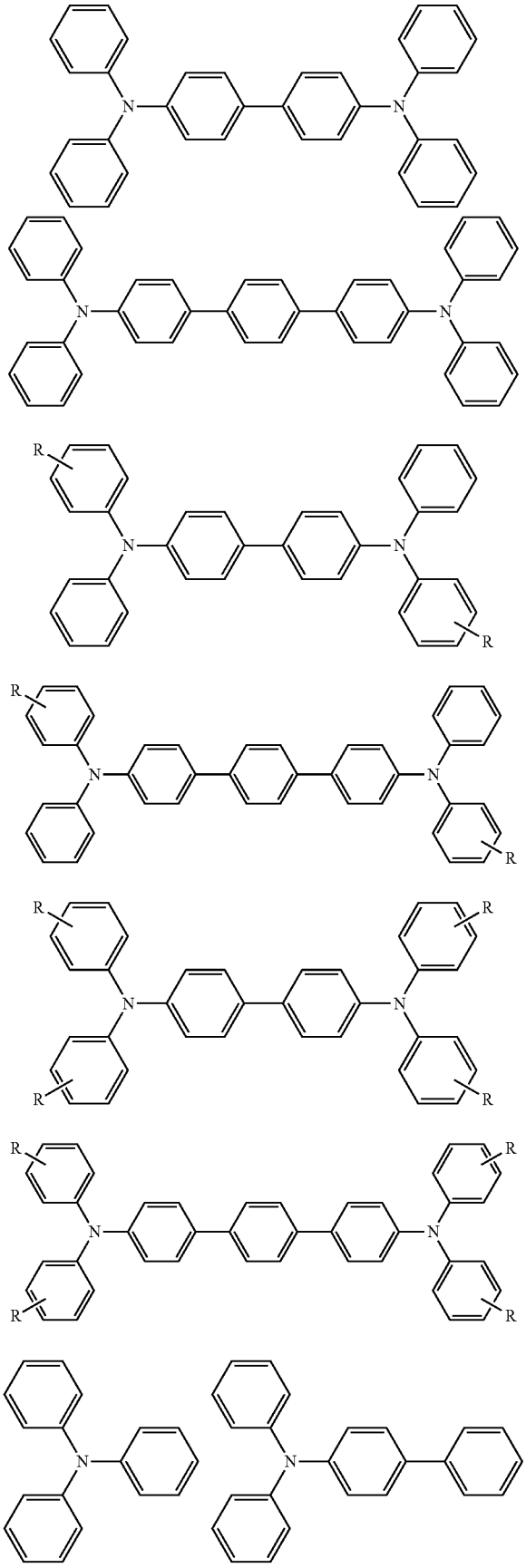

-continued

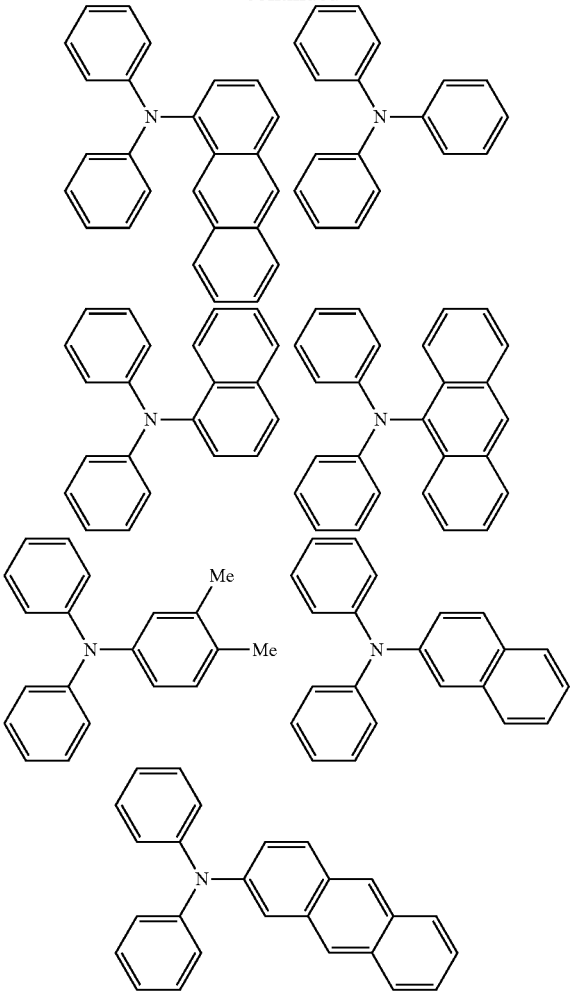

wherein R represents a hydrogen atom, an aryl group, or an alkyl group optionally containing a substituent.

The inclusion of these photoactive materials in the present embodiments provides for the omission of certain ingredients that are typically needed in single layer photoreceptors. For example, most conventional single layer photoreceptors require the use of a material for transporting holes, a material for transporting electrons, a material for generating charge (typically a pigment), as well as a polymer binder.

For example, it has recently been discovered that a triarylamine such as the charge transport molecule TPD can transport both holes and electrons with similar mobility. As described in S. C. Tse et al., "Electron transport in naphthylamine-based organic compounds," Appl. Phys. Lett. 89, Art. No. 262102-1 (2006), electron transport has been seen in materials such as N,N'-di(naphthalene-1-yl)-N,N'-diphenylbenzidine) (NPB). However, observable electron in TPD was unexpected to the inventors.

The exemplary embodiments of this disclosure are described below with reference to FIG. 1. The specific terms are used in the following description for clarity, selected for illustration in the Figure and not to define or limit the scope of the disclosure. The structures in the Figure are not drawn according to their relative proportions and the drawing should not be interpreted as limiting the disclosure in size, relative size, or location. In addition, though the discussion will address positively charged systems, the imaging members of the present disclosure may also be used in negatively charged systems.

FIG. 1 is an exemplary embodiment of a single-layered electrophotographic imaging member 5. As can be seen, the exemplary imaging member includes a metalized support member 10 and a single layer 15 disposed over the metalized substrate or support member 10. The metalized substrate 10 further comprises a substrate 10A and a metal layer 10B. In embodiments, the substrate can comprise any suitable material such as, for example, MYLAR® a commercially available polymer. In embodiments, the metal layer can comprise any suitable metal such as, for example, aluminum, titanium, or zirconium, and mixtures thereof. In one embodiment, the substrate is comprised of MYLAR, and the metal layer is comprised of aluminum. In embodiments, the substrate 10A has a thickness of from about 10 μm to about 200 μm, or from about 50 μm to about 150 μm, or from about 90 μm to about 110 μm, and the metal layer 10B has a thickness of from about 10 nm to about 100 nm or from about 25 nm to about 85 nm, or from about 45 nm to about 55 nm. The single layer 15 comprises a homogenous layer of a tri-arylamine, like TPD, as the hole transport molecule 20 in a polycarbonate binder.

The Substrate

The photoreceptor support substrate 10 may be opaque or substantially transparent, and may comprise any suitable organic or inorganic material having the requisite mechanical properties. In embodiments, the electrically conductive surface can be merely a coating on the substrate. Any suitable electrically conductive material can be employed, such as for example, metal or metal alloy. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, the belt can be seamed or seamless. In embodiments, the photoreceptor herein is in a flexible belt configuration.

The thickness of the substrate 10 depends on numerous factors, including flexibility, mechanical performance, and economic considerations. The thickness of the support substrate 10 of the present embodiments may range from about 500 micrometers to about 3,000 micrometers, or from about 750 micrometers to about 2500 micrometers.

An exemplary substrate support 10 is not soluble in any of the solvents used in each coating layer solution, is optically transparent or semi-transparent, and is thermally stable up to a high temperature of about 150° C. A typical substrate support 10 used for imaging member fabrication has a thermal contraction coefficient ranging from about $1\times10^{-5}$ per ° C. to about $5\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Single Layer

The single layer 15 is disposed upon the substrate 10. The single layer 15 comprises a tri-arylamine as a hole transport molecule in a binder. Examples of the binder materials selected for the charge transport layer include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the binder is a polycarbonate binder selected from the group consisting of poly(bisphenol-A carbonate), poly (bisphenol-Z carbonate), or poly(bisphenol-A carbonate)-co-poly(bisphenol-Z carbonate), and mixtures thereof. In embodiments, electrically inactive binders are comprised of polycarbonate resins with a molecular weight of from about 20,000 to about 100,000, or with a molecular weight M w of from about 50,000 to about 100,000 preferred. Generally, the transport layer contains from about 10 to about 75 percent by weight of the charge transport material, and more specifically, from about 35 percent to about 50 percent of this material.

In embodiments, the tri-arylamine has the following formula:

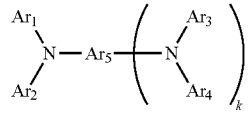

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1. $Ar^5$ may be further defined as, for example, a substituted phenyl ring, substituted/unsubstituted phenylene, substituted/unsubstituted monovalently linked aromatic rings such as biphenyl, terphenyl, and the like, or substituted/unsubstituted fused aromatic rings such as naphthyl, anthranyl, phenanthryl, and the like. In further embodiments, the tri-arylamine may be selected from any of the following group:

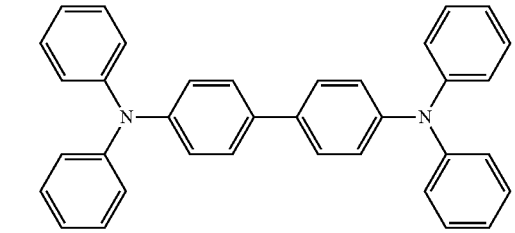

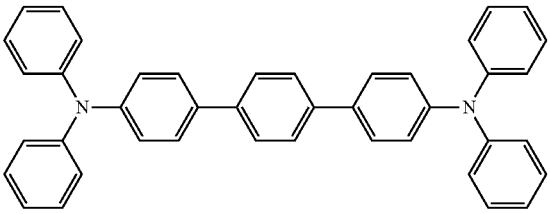

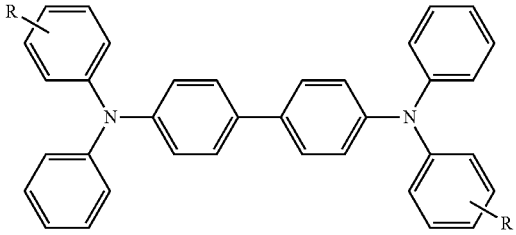

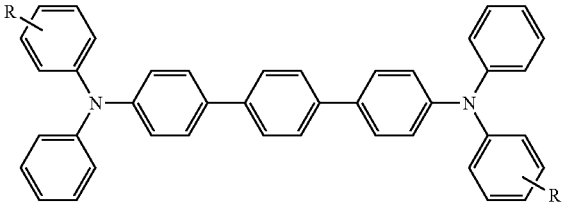

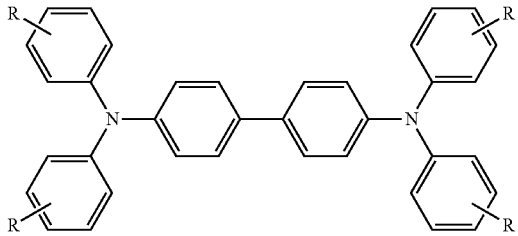

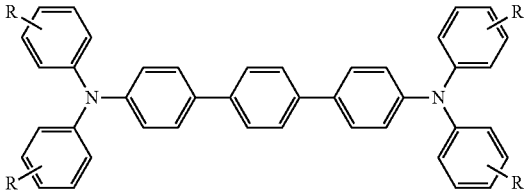

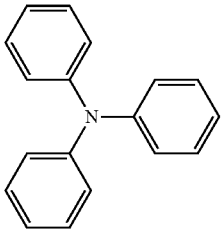

-continued

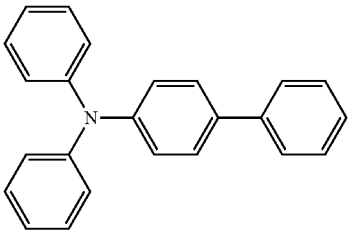

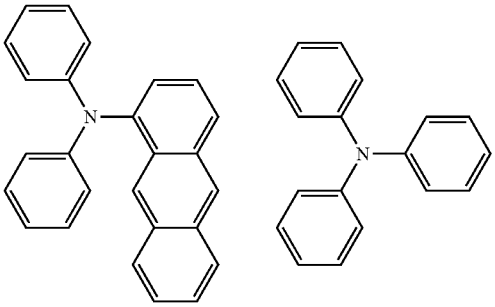

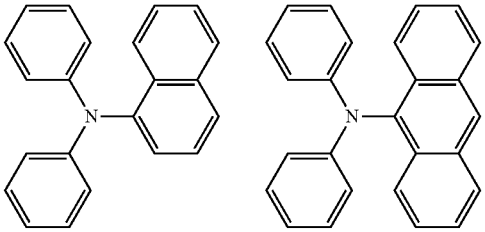

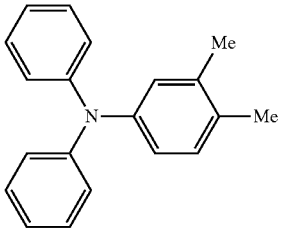

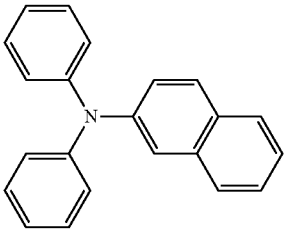

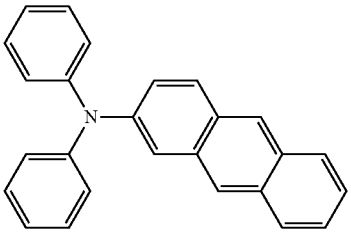

wherein R represents a hydrogen atom, an aryl group, or an alkyl group optionally containing a substituent.

In embodiments, the tri-arylamine is present in an amount of from about 10 percent to about 90 percent, or from about 25 percent to about 75 percent, or from about 40 percent to about 60 percent, by weight of the total weight of the single layer 15. In embodiments, the polycarbonate binder is present in an amount of from about 10 percent to about 90 percent, or from about 25 percent to about 75 percent, or from about 40 percent to about 60 percent, by weight of the total weight of the single layer 15.

Examples of components or materials optionally incorporated into the single layer of the imaging member, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N2-hydroxyethyl-N-ethyl-aminophenyl)]-phenylmethane (DHTPM), and the like. The weight percent of the antioxidant in the single layer is from about 0 to about 20, from about 1 to about 10, or from about 3 to about 8 weight percent.

Any suitable and conventional technique may be utilized to form and thereafter apply the single layer 15 to the supporting substrate layer 10. The single layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the single layer after drying is, in embodiments, from about 10 μm to about 60 μm, or from about 15 μm to about 45 μm, or from about 20 μm to about 30 μm. As provided, the single layer may have a thickness that is thicker than conventional photoreceptor layers.

The observation of the unexpected electron transport in TPD was made using the "time-of-flight" technique. In this technique, the motion of a wave of charge through a charge transporting layer can be recorded as a function of time. In the test, the sample material in question is sandwiched between blocking (non-charge injecting) semi-transparent electrodes. An electric filed is then applied followed by a short pulse of light shone through one of the electrodes. The wavelength of the light is selected so as to absorb strongly in the sample material. The absorbed light generates charge that is subsequently transported through the bulk of the sample while an oscilloscope, connected to the electrodes via an electric circuit, records the motion of charge as a function of time. The resulting oscilloscope trace is referred to as a transient. Through this time-of-flight method, the transport of either holes or electrons is evaluated depending on the bias that is applied to the electrodes relative to which electrode the excitation light is shone through.

Figure 2:
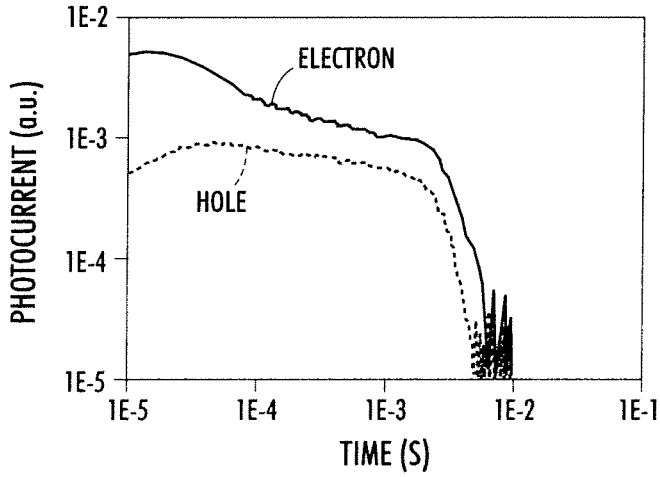
FIG. 2 is a graph illustrating hole and electron transients of an imaging member according to the present embodiments.
Figure 3:
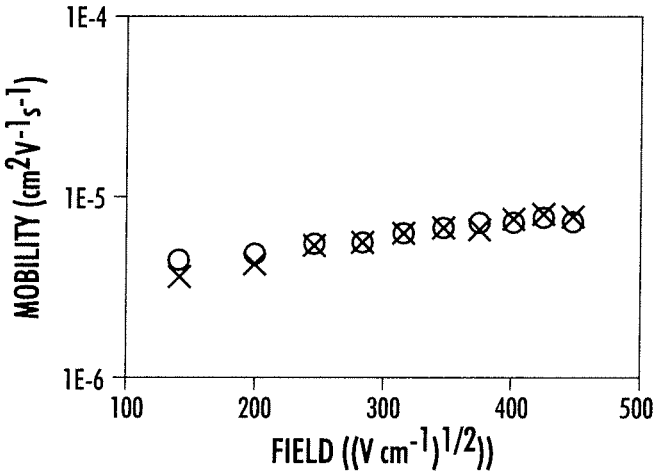
FIG. 3 is a graph illustrating hole and electron mobility as a function of electric field in an imaging member according to the present embodiments.

FIG. 2 illustrates the hole and electron transients of a representative 20 μm layer comprising 50 percent by weight of TPD in 50 percent by weight of polycarbonate. As can be seen, the shapes of the hole and electron transients are fairly similar, which is indicative of similar transport characteristics for both holes and electrons in the layer. The location of the "knee" in the transient, at about 2 ms, roughly corresponds to the charge carrier transit time. It can be seen that the transit time for holes is similar to that of electrons, and hence the hole and electron mobility are similar. The hole as compared to electron mobility as a function of applied electric field is illustrated in FIG. 3 (hole represented by circles and electron represented by x's).

It should be noted that, for ease of comparison, the laser pulse intensity used for the transients shown in FIG. 2 was adjusted so that the hole versus electron transients displayed roughly the same level of photocurrent. Without the adjustment, when the pulse intensity is held constant, it was found that the photocurrent for hole transport was more than an order of magnitude greater than that of the electron transport.

Figure 4:
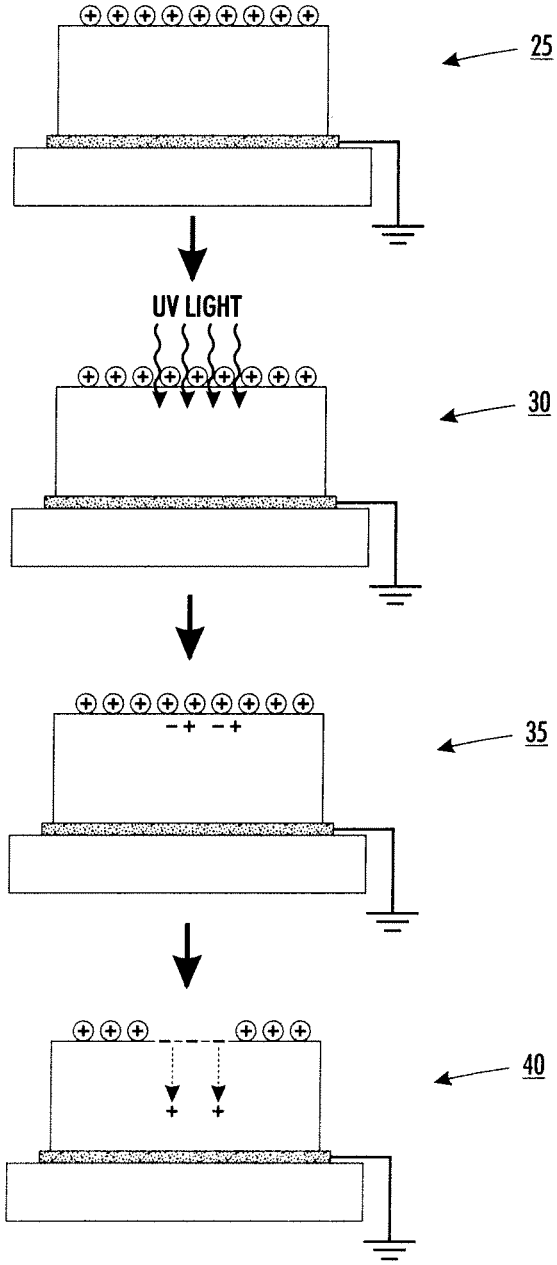
FIG. 4 is a representative diagram of a method of using an imaging member according to the present embodiments.

In the present embodiments, as shown in FIG. 4, the latent electrostatic image is created on the single layer imaging member by positively electrostatically charging the imaging member 25 and then raster scanning an UV laser beam on the surface of the device to selectively discharge it 30. In regions where the laser is shone, the UV light is absorbed strongly by the TPD molecules and electron hole pairs are generated near the imaging member's surface 35. In embodiments, about 90 percent of the UV light is absorbed within about 6 μm of the surface. Due to the electric field applied by the static charge on the surface of the imaging member, these electron hole pairs separate and charge is transported in accordance to the direction of the field 40. For example, in the case of positive electrostatic charging of the imaging member surface, the holes are transported through the bulk of the device toward the ground electrode and electrons are transported a short distance to the surface where they neutralize the positive static charge. Once a latent electrostatic image has been created, the standard xerographic development and transfer processes can be followed to manifest that image on a substrate, such as a sheet of paper.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

Single Layer Photoreceptor Fabrication

The single layer tri-arylamine based photoreceptor can be fabricated in a similar fashion to the dual-layer photoreceptors. However, lab-based fabrication procedures were employed for the purposes of reducing the concept to practice. The photoreceptor structure comprises a suitable, metalized support member or substrate coated with a homogenous layer of TPD in a polycarbonate binder, as depicted in FIG. 3. In the case of the prototype device, the support member consisted of a 100 μm thick 4"×4" sheet of aluminized MYLAR available from E.I. du Pont de Nemours and Co. (Dover, Del.).

The substrate was first rinsed with isopropyl alcohol and wiped dry with a paper tissue. The TPD-containing layer was then applied by blade coating a solution of 50 weight percent TPD and 50 weight percent polycarbonate dissolved in dichloromethane (at a solid content of 18 weight percent) onto the substrate. An appropriate blade gap was chosen so that the thickness of the layer would be 25 μm when dried. Care was taken during the coating process to ensure that a strip of the metal ground plane along the edge of the substrate was left bare so that electrical contact could be made subsequent to the application of the TPD layer. The coated single layer was then allowed to dry in air for about 1 hour at room temperature and then was heat-treated in an oven at 120° C. for 30 minutes to remove any remaining solvent.

Example 2

Evaluation of Single Layer Photoreceptor

Figure 5:
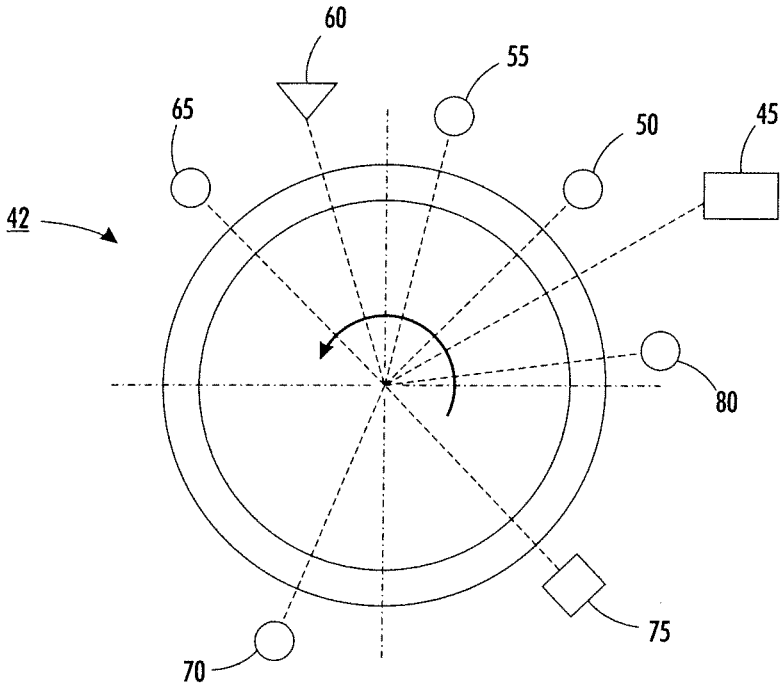
FIG. 5 is a schematic diagram indicating the relative positions of various elements in an universal drum scanner used with an imaging member according to the present embodiments.

To demonstrate the operation of the single layer photoreceptor, the prototype device was xerographically cycled on an universal drum scanner. The drum scanner comprises a "paperless- and tonerless" fixture in which the cyclic photoelectrical performance of a photoreceptor is evaluated under controlled experimental conditions. An 84 mm drum carrying a sample photoreceptor, such as the one described above, was mounted about a central axis and automatically rotated about the axis at a controlled speed. The Expose station (UV laser), charging scorotrons and electrostatic voltmeters (ESVs) are situated at various angular positions around the drum, as shown in FIG. 5. In this example, the xerographic scanner 42 was set up to include the following: a positive scorotron 45 at an angular position of 0 degrees, a first ESV 50 at 43 degrees, a second ESV 55 at 67 degrees, an expose station 60 at 80 degrees, a third ESV 65 at 138 degrees, a fourth ESV 70 at 225 degrees, a heating element 75 at 280 degrees, and a fifth ESV 80 at 320 degrees.

Figure 6:
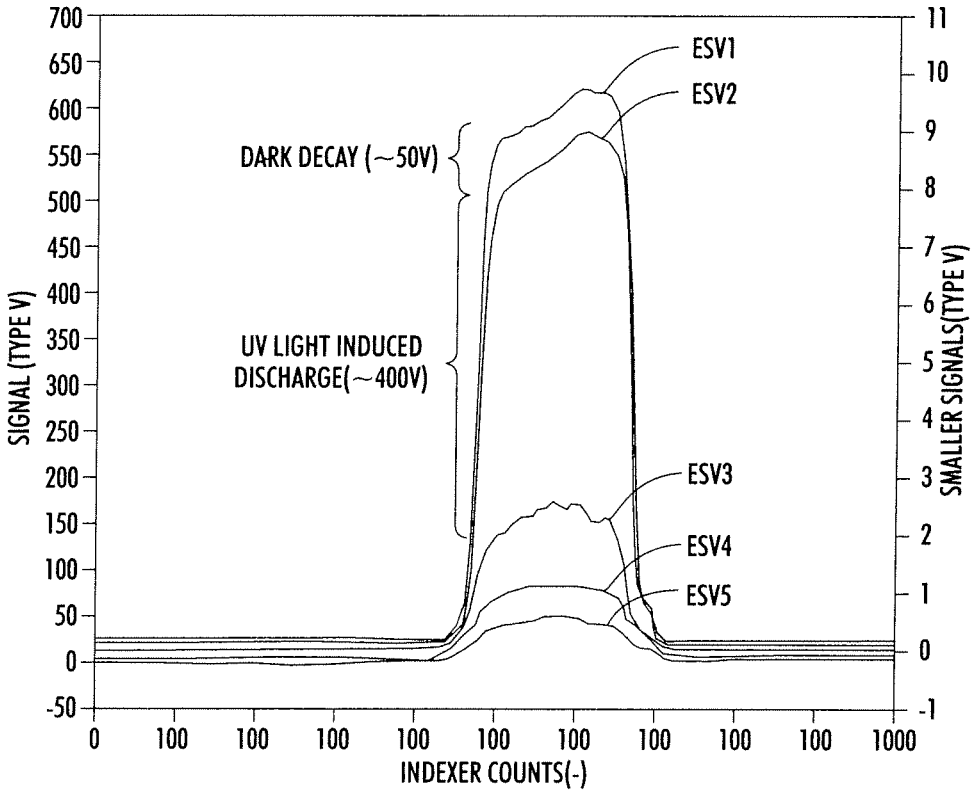
FIG. 6 is a graph illustrating the recording of electrostatic charge as the drum is rotated in the imaging member of FIG. 5.

To evaluate the single layer photoreceptor, the prototype device was mounted on a blank aluminum 84 mm drum. The photoreceptor was fixed to the drum with conductive copper tape along the four edges of the device. The photoreceptor was electrically connected to the drum through the copper tape contacting the exposed ground plane of device and a resistance of less than 1K ohm was measured by a multimeter. The drum was then mounted in the scanner. The prototype device was then cycled under various conditions to evaluate its electrical performance as a photoreceptor, i.e., its ability to be cyclically electrostatically charged and then photo-discharged, and the stability thereof. In one regime, the drum was rotated at 0.5 Hz (equivalent to 69 pages per minute) with the positive scorotron wire set at +75 mA and grid set at +1000V (typical settings for a positive scorotron in an image-forming apparatus), the laser set to expose the device to 3,415 ergs/cm$^2$ of UV light at a wavelength of 337 nm (close to the wavelength at which there is maximal light absorption in TPD), and the heating element set to increase the temperature of the photoreceptor to 50-70° C. Under these conditions in the drum scanner, the prototype device was cyclically electrostatically charged positive by the scorotron, and then the charge on the device was measured by ESV1 and then ESV2. Subsequently, the device was exposed to the UV laser causing discharge of the positive charged surface, and then the remnant charge on the device was measured by ESV3, ESV4, and then ESV5. The scanner continuously recorded the electrostatic charge on the device from each ESV as the drum rotated. The data captured on about the 100$^{th}$ cycle is shown in FIG. 6, where the streaming ESV data (y-axis) is plotted as a function of time (x-axis). The ESV traces are shifted in time relative to one another so that readings at a single point on the drum can be easily compared. For instance, in the plot, each of the traces rise together as they measure the change in voltage between the bare metal drum (which holds no static charge) and the photoreceptor (which holds static charge), when in fact each of ESV1 through ESV5 measures this change sequentially as the drum rotates past each ESV. Thus, FIG. 6 records the data from the ESV traces to show charging, dark decay, and photo-induced discharge of the prototype device after about 100 cycles while running at a speed of about 70 pages per minute.

Starting on the left of FIG. 6, the ESV's read about 0V as they trace the static charge on the bare metal portion of the drum. At about 450V indexer counts there is a sudden increase in measured charge as the ESV's cross from the bare metal to the photoreceptor device mounted on the drum. At this point, ESV1 located immediately after the scorotron reads an average 600V on the photoreceptor. Within 133 ms the charge on the photoreceptor read by ESV2 is about 550V. This decrease of 50V is due to dark decay, and is typical for an organic photoreceptor. After ESV2, the photoreceptor is exposed to the UV laser after which ESV3 measures about 150V on the device—discharge of about 400V in 322 ms. This discharge speed is on the same order as photoreceptors that are on the market today. At ESV4, the charge has further dropped to about 80V. Finally at ESV5, some 1,300 ms after exposure, the voltage is about 40V. Note that in this example there is no erase light and that if one was included, the voltage at ESV5 could likely be reduced to close to 0V.

In conclusion, the ESV data indicates that the single layer photoreceptor can be stably operated at a rotational speed of about 70 pages per minute with a light-induced discharge of about 400V—performance figures that are within the order of current dual layer designs.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An image forming apparatus for forming images on a substrate comprising:

a) a single layer imaging member having a charge retentive-surface for receiving an electrostatic latent image thereon, wherein the single layer imaging member comprises a metalized substrate, and a single layer disposed over the metalized substrate, the single layer further comprising a photoactive material to act as a hole transport molecule, an electron transport molecule and a charge generating material in a polymeric binder;

b) an ultra violet light source providing ultra violet light to selectively discharge the charge retentive-surface;

c) a development component for applying a developer material to the charge-retentive surface to develop the electrostatic latent image to form a developed image on the charge-retentive surface;

d) a transfer component for transferring the developed image from the charge-retentive surface to a substrate; and e) a fusing component for fusing the developed image to the substrate;

wherein the single layer imaging member is free of photosensitive pigments and electron transporting small molecules.

2. The image forming apparatus of claim 1, wherein the photoactive material comprises a tri-arylamine and the polymeric binder comprises a polycarbonate binder.

3. The image forming apparatus of claim 2, wherein the tri-arylamine has the following formula:

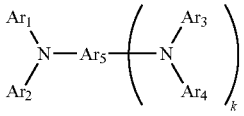

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1.

4. The image forming apparatus of claim 2, wherein the tri-arylamine is selected from the group consisting of:

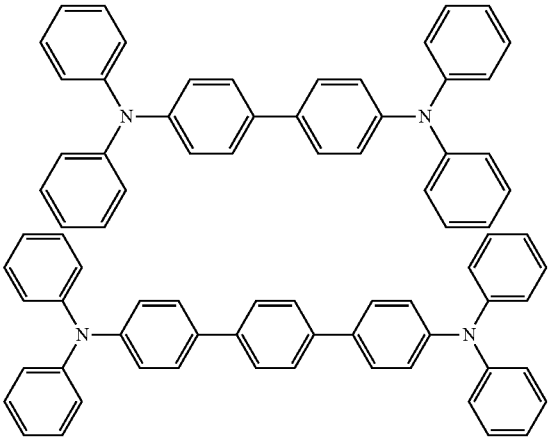

-continued

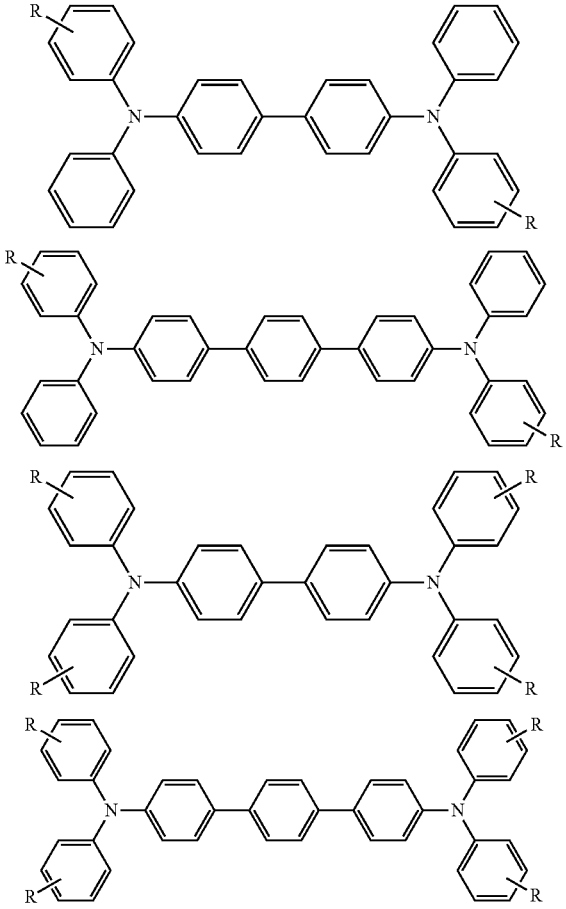

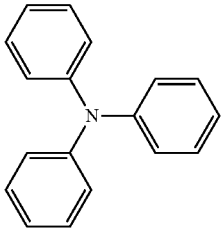

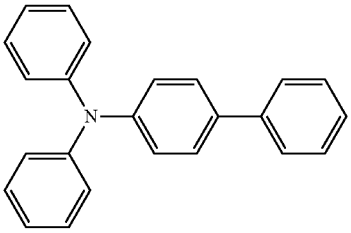

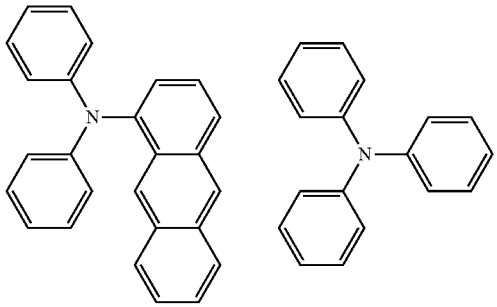

-continued

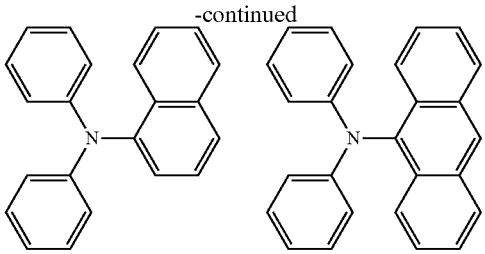

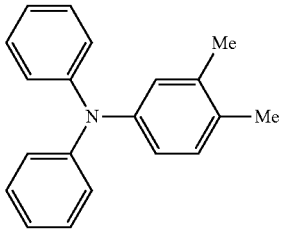

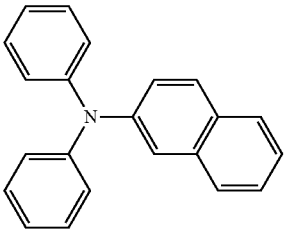

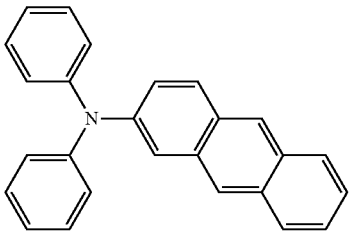

wherein R represents a hydrogen atom, an aryl group, or an alkyl group and optionally containing a substituent.

5. The image forming apparatus of claim 2, wherein the tri-arylamine is N—N'-diphenyl-N,N'-bis(3-methylphenyl)-[1,1'-biphenyl]-4,4'-diamine.

6. The image forming apparatus of claim 2, wherein the tri-arylamine is present in an amount of from about 10 percent to about 90 percent by weight of the total weight of the single layer.

7. The image forming apparatus of claim 1, wherein the single layer has a thickness of from about 10 μm to about 60 μm.

8. The image forming apparatus of claim 1, wherein the polymeric binder is selected from the group consisting of polycarbonates, polyarylates, acrylate polymers, vinyl polymers, cellulose polymers, polyesters, polysiloxanes, polyamides, polyurethanes, poly(cyclo olefins), epoxies, and mixtures thereof.

9. The image forming apparatus of claim 1, wherein the metalized substrate has a thickness of from about 10 μm to about 200 μm.

10. The image forming apparatus of claim 1, wherein the metal of the metalized substrate is selected from the group consisting of aluminum, titanium, zirconium, and mixtures thereof.

11. The image forming apparatus of claim 1, wherein the substrate material of the metalized substrate is selected from the group consisting of polyethylene terephthalate, polyethylene naphthalate, and mixtures thereof.

12. The image forming apparatus of claim 1, wherein the polymeric binder is present in an amount of from about 10 percent to about 90 percent by weight of the total weight of the single layer.

13. The image forming apparatus of claim 1, wherein the ultra violet light is placed on the charge retentive-surface of the single layer imaging member.

* * * * *